US005103849A

United States Patent [19]

Hamner

[11] Patent Number: 5,103,849

[45] Date of Patent: Apr. 14, 1992

[54] HIKER'S STAFF WITH POINT

[76] Inventor: Lewis N. Hamner, 14502 Green Forest Dr., Colonial Heights, Va. 23834

[21] Appl. No.: 627,862

[22] Filed: Dec. 17, 1990

[51] Int. Cl.[5] ..... A45B 9/04

[52] U.S. Cl. ..... 135/77; 135/78

[58] Field of Search ..... 135/65, 77, DIG. 11, 135/78, 81

[56] References Cited

U.S. PATENT DOCUMENTS

| | | | |
|---|---|---|---|
| 2,453,742 | 11/1948 | Bowen et al. | 135/77 |
| 2,799,287 | 7/1957 | Wagner | 135/77 |
| 2,910,995 | 11/1959 | Jacuzzi | 135/77 |
| 3,163,437 | 12/1964 | Phillipson | 135/77 X |
| 3,524,456 | 8/1970 | Dixon | 135/77 X |
| 4,562,851 | 1/1986 | Frank | 135/78 |
| 4,601,302 | 7/1986 | Breen et al. | 135/78 X |
| 4,811,750 | 3/1989 | McAllister | 135/84 X |

FOREIGN PATENT DOCUMENTS

| | | | |
|---|---|---|---|
| 178690 | 6/1954 | Austria | 135/81 |
| 1023240 | 12/1977 | Canada | 135/78 |
| 2020193 | 3/1972 | Fed. Rep. of Germany | 135/77 |
| 73736 | 11/1916 | Switzerland | 135/77 |
| 591827 | 9/1977 | Switzerland | 135/77 |

*Primary Examiner*—David A. Scherbel
*Assistant Examiner*—Lan Mai
*Attorney, Agent, or Firm*—Staas & Halsey

[57] ABSTRACT

A hiker's staff having a special hiker's point of rugged dimensions, telescoped over the lower end. The hiker's point has a vertically mounted plate with a truncated tapered notch at the lower end to define two square support areas on each side thereof, with the notch permitting the anchoring of snakes and the like to the ground.

6 Claims, 1 Drawing Sheet

HIKER'S STAFF WITH POINT

This invention relates to a hiker's point design for use on a hiker's staff. Walking and hiking have become a popular form of recreational exercise. Some walkers use a staff, such as a cane, to assist during the walk. The staff permits the fending off of barking dogs, assists in pushing aside bushes, serves as a walking aid, etc. The staff may have a metal point for decorative purposes, and primarily to prevent wear of the bottom of the staff if it is made of a material such as wood. Generally, these metal points are ferrules, or cups, that fit over the end of the staff. Others have provided special ends or points for antislipping, such as shown in U.S. Pat. No. 2,799,287. Other special ends or points are shown in U.S. Pat. Nos. 3,163,437; 3,524,456; 4,601,302; and 4,811,750. Also, sticks have been cut in the past with forked branches that can be used to anchor snakes.

The present invention is an improved point for staffs, especially for hikers in mountainous areas. The staff is preferably 53" long including the point, and has a recess at the top in which a compass can be inserted. The staff portion is preferably of good, straight and tough wood, and the point telescopes over the bottom end of the staff and is held in place by a metal pin. The end of the staff is a metal plate of rugged design and substantial thickness, which is integral with the point and may be made up of weldments or machined or precision-cast from tough, high-strength metal. It is preferably made of a corrosion-resistant material or a material coated with a corrosion-resistant surface. The plate forming the end is approximately 1∫8 square, with a tapered notch at its lower end of approximately ¾" width, tapering to ¼" in width, thus forming a truncated V-notch that can be used for various purposes including anchoring of the head or body of a snake caught within the notch. The square plate is left with square corners, which provides better anchoring to the staff when it is used, especially on slippery surfaces such as ice. The rugged point provides substantial protection for the user of the staff, and protects the point of the staff from wear, even when used on rugged, rocky terrain. The various advantages of the invention including its ruggedness, simplicity, usefulness, and strength will become apparent hereinafter when reviewed in the light of the drawings and the following description.

DETAILED DESCRIPTION OF THE INVENTION

Figure 1:
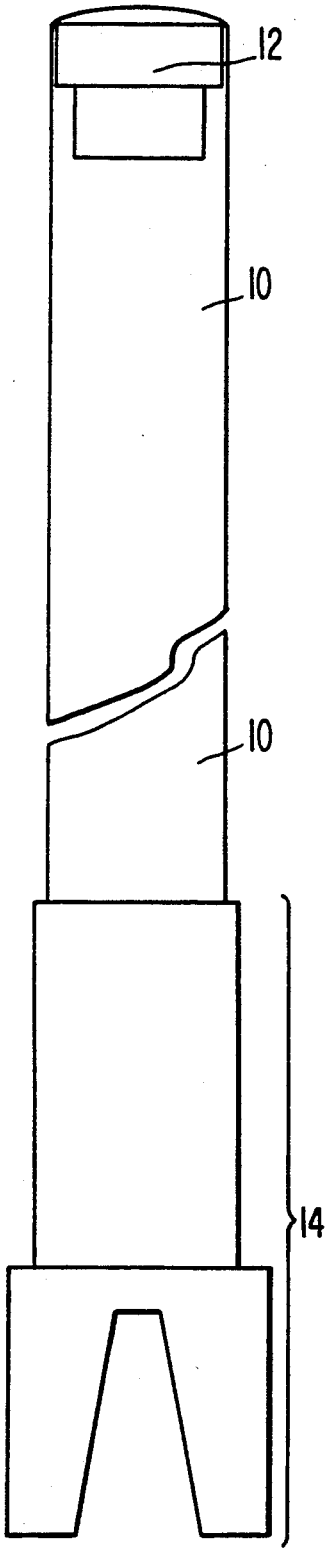
FIG. 1 is a view of the hiker's point and staff which is cut away to show the compass mount.
Figure 2:
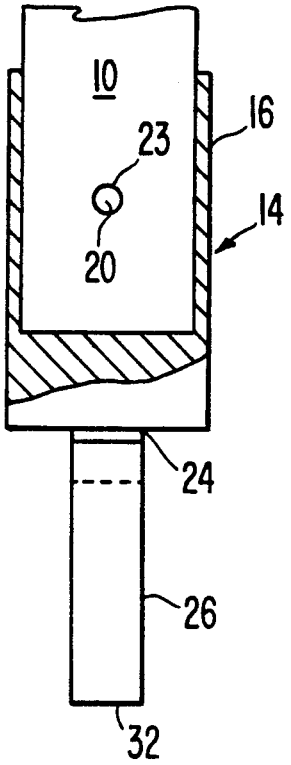
FIG. 2 is a side view of the hiker's point with partial cross section in the portion that telescopes over the staff.
Figure 4:
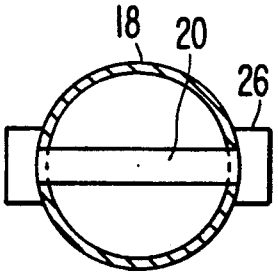
FIG. 4 is a top view of the hiker's point.
Figure 3:
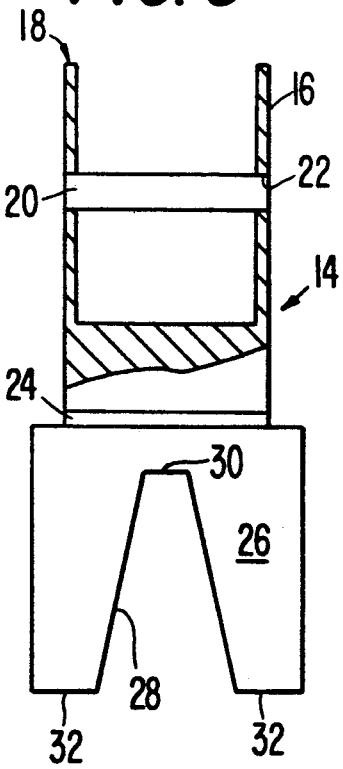
FIG. 3 is a front view of the hiker's point similar to FIG. 2.
Figure 5:
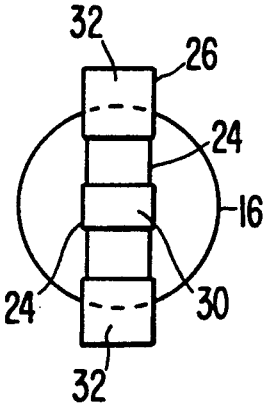
FIG. 5 is bottom view of the hiker's point.

With further reference to the drawings, there is shown in FIG. 1 the staff 10, which is recessed at the top 12 to receive a compass, and is terminated at the lower end by a hiker's point 14. The entire staff has a preferred height of 53", with the main body being made of a suitable wood. As used in this description, staff includes any stick, cane or pole which may be carried as an aid in walking or climbing.

The hiker's point is preferably made up of a corrosion-resistant steel or a steel which is treated to be corrosion-resistant, but may be made of any other suitable material that provides wear-resistance, strength and corrosion resistance suitable for forming the hiker's point.

The hiker's point is preferably a total of 3 and 9/16" in length, with the top portion being in the form of a cup 16, having an overall depth of 2", and an inside depth of 1½" inches and an inside diameter of 1". The cup has a wall 18 which is circular in shape and preferably 1/16" thick. The 1" inside diameter is designed to receive a staff having the same diameter for a tight connection. The staff is telescoped into the cup and is held by friction as well as by a through-pin 20. The pin is preferably 3/16" in diameter, and may be tack-welded to the outside wall of the cup 16, with the weld ground flush with the outside wall.

To accommodate the pin 20, two orifices 22 are provided in the wall on opposite sides thereof. Likewise, an orifice 23 for receiving the pin is provided in the lower end of the staff in a position to line up with the orifices 22 in the walls. The pin 20 may also be held in place by a drive or friction fit.

The bottom of the cup 16 is preferably welded at weld 24 to the top of notch plate 26. The weld is preferably a 1/16" weld that extends on both sides of the notched plate 26 where it meets the bottom of the cup 16.

The notch plate 26 is preferably ⅜" thick and 1½" square. At the lower side of the plate is provided a tapered notch 28. The tapered notch is preferably ¼" wide and 1 and ¼" deep having a truncated top 30 which is ¼" wide. By this arrangement, the bottom of the plate has two support areas 32 which are each preferably ⅜" square, and are opposite the truncated tapered notch 28.

The preferred embodiment shown is made of two pieces which are welded together to form an integrated hiker's point. However, it can be appreciated the entire piece can be a casting such as a precision casting of a suitable metal such a stainless steel. Any other suitable method of fabricating can also be used, and would be apparent to those skilled in the art.

Thus, there has been shown in the above description and accompanying drawings a hiker's or walker's staff with a unique point that is rugged and tough, and provides wear resistance to the staff. It can be used to fend off snapping dogs, can serve to better grip the surface of the terrain which is being traversed (especially ice and the like where the square support areas can more readily dig in), and can be used to push aside bushes and anchor snakes and the like. In anchoring snakes, the user would be separated by the length of the staff and can use the V-shaped notch to straddle the snake's head or body to anchor it to the ground.

Although this invention has been described with reference to one specific form thereof, it will be appreciated that various modifications may be made without departing from the scope of this invention. For example, the dimensions may be changed, and other materials may be substituted for the steel which is preferred, all without departing from the spirit and scope of the invention as defined in the appended claims.

What is claimed is:

1. A point for a staff comprising:

a cup for affixing said point to the lower end of a staff;

a vertical, flat, substantially rectangular plate, having two substantially vertical flat sides parallel to one another, a lower surface and a top;

said plate integrally attached at said top to said cup to form a one-piece structure;

an exposed tapered notch narrowing upwards located in said lower surface of said plate; and a support area in said lower surface on each side of said notch.

2. The point of claim 1, wherein said cup is cylindrical and adapted to telescope over the end of a staff.

3. The point of claim 1, wherein said plate is approximately $\frac{3}{8}''$ thick and approximately $1\frac{1}{2}''$ wide with said notch being approximately $\frac{3}{4}''$ wide at the bottom.

4. The point of claim 3, wherein said plate is approximately $1\frac{1}{2}''$ high and said notch is approximately 1 and $\frac{1}{4}''$ deep.

5. The point of claim 4, wherein said notch is truncated at the top and approximately $\frac{1}{4}''$ wide at the truncation.

6. The point of claim 5, wherein said support areas are approximately $\frac{3}{4}''$ square.

* * * * *